United States Patent [19]

Weber

[11] Patent Number: 4,598,552

[45] Date of Patent: Jul. 8, 1986

[54] ENERGY SOURCE FOR CLOSED CYCLE ENGINE

[75] Inventor: Kent Weber, Rockford, Ill.

[73] Assignee: Sundstrand Corporation, Rockford, Ill.

[21] Appl. No.: 633,212

[22] Filed: Jul. 19, 1984

[51] Int. Cl.[4] ..... F01K 25/00

[52] U.S. Cl. ..... 60/673; 60/721; 60/649; 126/263

[58] Field of Search ..... 60/649, 673, 721; 126/263

[56] References Cited

U.S. PATENT DOCUMENTS

| | | |
|---|---|---|
| 2,706,890 | 4/1955 | Schmidt . |
| 3,101,592 | 8/1963 | Robertson et al. . |
| 3,302,401 | 2/1967 | Rockenfeller . |
| 3,328,957 | 7/1967 | Rose . |
| 3,973,392 | 8/1976 | Hallqvist . |
| 3,975,913 | 8/1976 | Erickson ..... 60/673 X |
| 4,257,232 | 3/1981 | Bell ..... 126/263 X |

*Primary Examiner*—Allen M. Ostrager

*Attorney, Agent, or Firm*—Wood, Dalton, Phillips Mason & Rowe

[57] ABSTRACT

An energy source for a closed cycle engine including a boiler (10) having a working fluid chamber (12) in heat exchange relation with a reaction chamber (14). A closed flow path loop (16, 34, 36, 38, 44, 46, 52) including a turbine (18) receives working fluid from the fluid chamber, provides a power output and returns the fluid to the chamber. Lithium (80) is reacted with water (70) in the reaction chamber (14) to generate heat for heating the working fluid and hydrogen. Oxygen, obtained by decomposition of sodium superoxide (82) elsewhere in the system, is fed to the reaction chamber (14) and combined with the hydrogen to provide water and additional heat for the working fluid.

2 Claims, 1 Drawing Figure

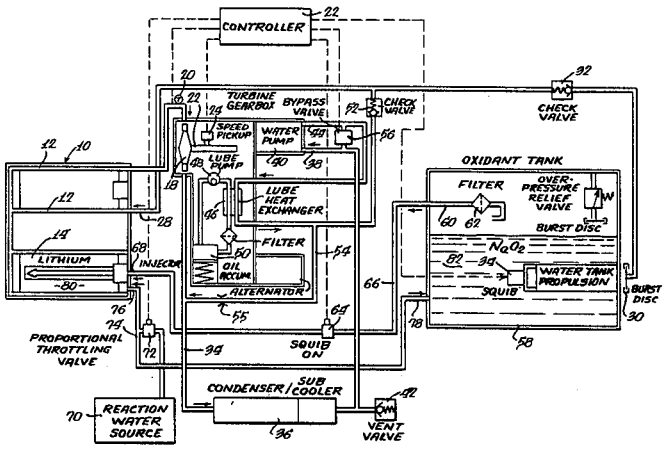

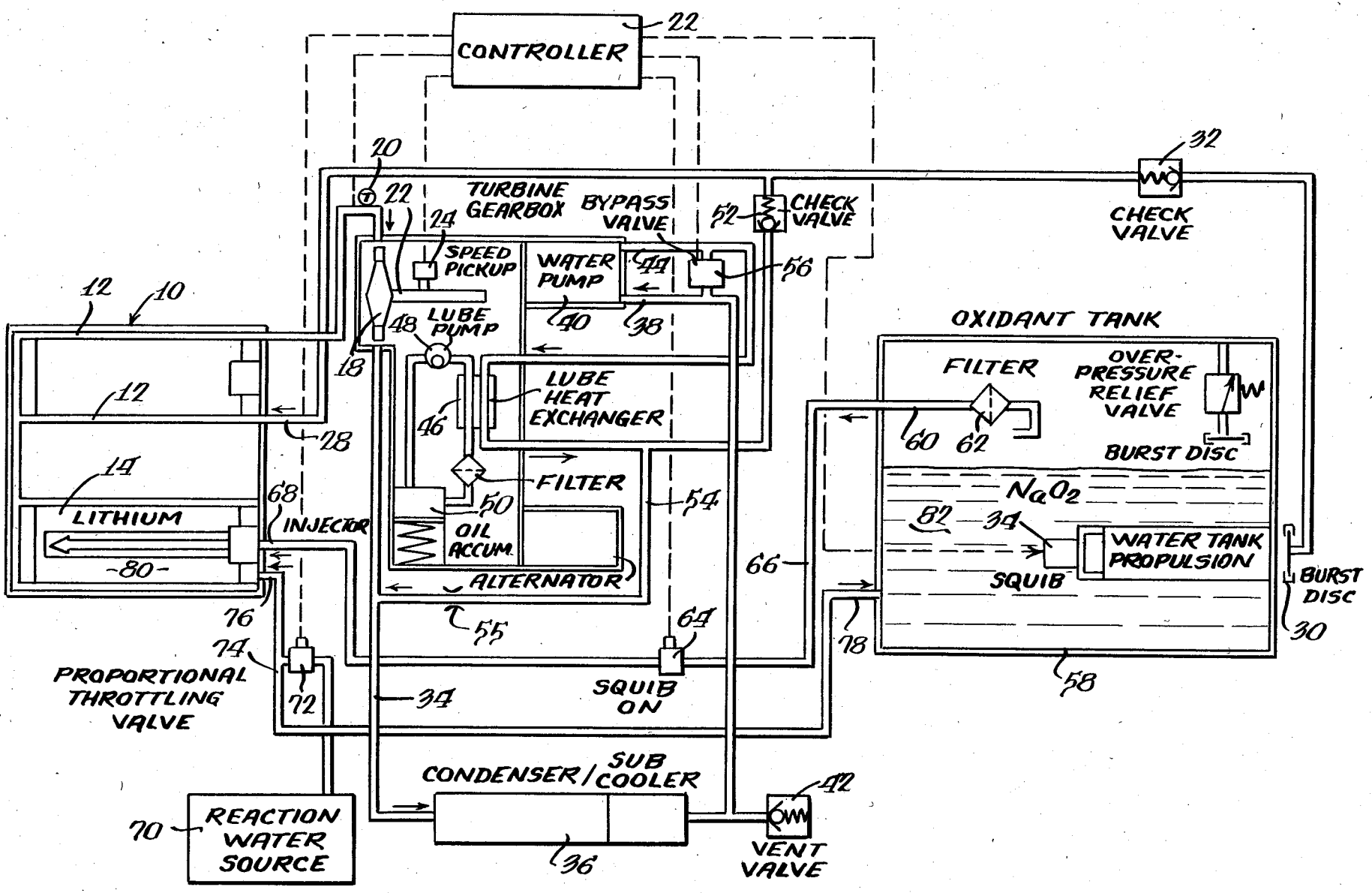
BURST DISC
30
CHECK VALVE
32
OXIDANT TANK
OVER-PRESSURE RELIEF VALVE
BURST DISC
WATER TANK PROPULSION
$NaO_2$
SQUIB
34
FILTER
62
60
82
58
78
CHECK VALVE
52
56
66
VENT VALVE
42
CONTROLLER
22
BYPASS VALVE
44
38
WATER PUMP
40
LUBE HEAT EXCHANGER
54
64
SQUIB ON
SUB CONDENSER/COOLER
36
TURBINE GEARBOX
SPEED PICKUP
24
LUBE PUMP
48
46
FILTER
50
OIL ACCUM.
ALTERNATOR
55
34
20
22
18
28
INJECTOR
68
72
76
74
PROPORTIONAL THROTTLING VALVE
REACTION WATER SOURCE
70
10
12
12
14
LITHIUM
80

ENERGY SOURCE FOR CLOSED CYCLE ENGINE

FIELD OF THE INVENTION

This invention relates to an energy source for a closed cycle engine, and more particularly, to a chemical energy source wherein heat is generated by exothermic chemical reactions and converted into power.

BACKGROUND OF THE INVENTION

Presently proposed heat sources for closed cycle engines, as for example used in torpedos, utilize a chemical reaction between lithium and sulfur hexafluoride to generate heat. The heat is applied to a working fluid, typically water, in a boiler which is vaporized therein. The resulting steam is fed to a turbine which provides for propulsion, condensed, and then returned via a pump to the boiler to be reused.

The sulfur hexafluoride is maintained in an oxidant tank and is injected at a controlled rate into a reaction chamber forming part of the boiler to react with lithium therein.

In the usual case, the lithium is in the form of a solid billet or the like and must be brought to a molten state for the reaction to proceed properly. This involves heating virtually the entire mass of the lithium and the boiler at least to the melting point of lithium (357° F.).

Thus, in order to provide start-up of the system, a high intensity heat source must be used. One such system utilizes any of a variety of known start grains or squibs and pellets of aluminum potassium perchlorate.

Because of the temperature generated, local hot spots within the boiler can result in damage to the boiler wall or working fluid tubes.

A further problem is the fact that such systems are not inexpensive and the product of the chemical reaction between lithium and sulfur hexafluoride is a mixture of molten salts that, when cooled, results in a extremely hard, rock-like structure. Consequently, if the boiler is to be cleaned for reuse, there is required an extended period of deactivation by soaking the boiler in water to assure that all of the lithium has been oxidized. Moreover, the boiler must be tumbled in a long and laborious procedure to break up and remove the solidified products of the oxidation reaction.

Still another difficulty attends the use of such systems. The oxidant, sulfur hexafluoride, is typically stored as a liquid under normal temperature conditions. If the storage temperature is cold, the vapor pressure may fall below the pressure required to self expel the sulfur hexafluoride from the storage tank in sufficient quantities to maintain the reaction at the desired rate. At very low storage temperatures, the sulfur hexafluoride may even freeze.

Conversely, at high storage temperatures, the sulfur hexafluoride may be in a super critical state which, when system operation is initiated, causes it to expand to a mixture of liquid and vapor. Such a dual phase mixture can cause intermittant periods of very high flow to the reaction chamber in the boiler, disturbing the temperature control system customarily employed in such systems to the point that proper control cannot be maintained. Additionally, the sulfur hexafluoride injection nozzles by which the sulfur hexafluoride is injected into the reaction chamber, experience severe corrosion at the interface with the molten lithium which deleteriously affects their ability to be reused, probably due to thermal decomposition of the sulfur hexafluoride resulting in hot free fluorine which aggressively attacks the nozzles.

The present invention is directed to overcoming one or more of the above problems.

Other prior art of possible relevance includes U.S. Pat. No. 3,328,947 issued July 4, 1967 to Rose.

SUMMARY OF THE INVENTION

It is the principal object of the invention to provide a new and improved energy source for a closed cycle engine. More specifically, it is an object of the invention to provide such an energy source which may be easily reused.

An exemplary embodiment of the invention achieves the foregoing objects in a structure including a boiler having a working fluid chamber in heat exchange relation with a reaction chamber and a closed flow path for working fluid including a power translating device which is connected to the working fluid for receiving pressurized working fluid therefrom and returning spent working fluid thereto. A body of material exothermically reactive with another material to produce a readily soluble compound and hydrogen is located in the reaction chamber and an oxygen inlet is provided to the working fluid chamber.

The system further includes a storage vessel having an oxygen outlet connected to the oxygen inlet and there is disposed a body of material in the storage vessel which is decomposible in the presence of another material to generate oxygen and a readily soluble compound. A source of the another material is provided and means are further included for directing the another material from the source to the reaction chamber to cause an exothermic reaction between the body of material therein and the another material and to generate hydrogen in the reaction chamber, as well as to provide the storage vessel with the another material to generate and drive oxygen to the reaction chamber to cause an exothermic reaction between the hydrogen generated therein and the oxygen. The exothermic reactions heat the working fluid in the working fluid chamber.

The reaction chamber in the storage vessel are readily prepared for reuse by introducing a solvent for the reaction products respectively found therein.

In a preferred embodiment of the invention, the closed flow path includes a turbine followed by a heat exchanger which in turn is followed by a pump. The heat exchanger receives spent working fluid from the turbine and the pump receives cooled working fluid from the heat exchanger and returns the same to the working fluid chamber.

In a highly preferred embodiment, the exothermically reactive material contained within the reaction chamber is lithium.

It is also preferred that the fluid reactive with the lithium and with the decomposible material is water.

The decomposible material is preferably a superoxide of a Group IA metal, preferably sodium, or secondarily potassium.

Other objects and advantages will become apparent from the following specification taken in connection with the accompanying drawings.

DESCRIPTION OF THE DRAWINGS

The Figure is a schematic of a power source made according to the invention.

DESCRIPTION OF THE PREFERRED EMBODIMENT

An exemplary embodiment of a power source made according to the invention is illustrated in the drawing and is seen to include an enclosed boiler, generally designated 10. The boiler 10 is in turn made up of two components in heat exchange relation with one another. One component is a working fluid chamber in the form of tubes 12. The other component is a reaction chamber 14. As will be seen, an exothermic chemical reaction is caused to occur in the reaction chamber 14 to provide heat to the tubes 12. This in turn heats a working fluid circulated within the tubes 12.

The working fluid chamber includes an outlet 16 which is connected as an inlet to a power translation device in the form of a turbine 18. A throttling valve or the like, shown at 20, is controlled in a conventional fashion by a controller 22 forming no part of the invention to regulate the rate of admission of the working fluid to the turbine 18 for speed control purposes.

The turbine 18 has a power output shaft 22 which may be connected to auxiliary components of the system as well as to a component to be driven, such as the propeller on a torpedo. A speed sensing pick-up device 24 of conventional construction is associated with the shaft 22 to provide speed information to the controller 22 so that the throttling valve 20 may be appropriately controlled.

In the preferred embodiment, the working fluid is water and the turbine 18 is steam driven. A first water supply tank 26 is provided and is connected to an inlet 28 to the working fluid chamber 12 via a burst disk 30 and a check valve 32. When the system is to be started, the controller 22 fires a squib 34 associated with the water tank 26. The resulting elevation in pressure causes the disk 30 to burst and the water in the tank 26 to be driven past the check valve 32 to the working fluid chamber 12 wherein it will be evaporated and superheated to drive the turbine 18.

After start-up, by reason of the provision of the check valve 32, the water tank 26 plays no part in the operation of the system.

Spent working fluid from the turbine 18 is passed along a conduit 34 to a condenser and subcooler 36 whereat the water or other working fluid is condensed and cooled to a temperature below its boiling point. From the condenser-subcooler 36, the water is directed to the inlet 38 of a water pump 40 which may be driven by an auxiliary power source such as a battery, although most frequently, it will be driven by the turbine 18. A vent valve 42 is interposed between the condenser-subcooler and the inlet 38 for the pump 40 for the purpose of bleeding off excess pressure should the pressure level in the system rise too high.

The water pump 40 directs the water out of an outlet 44 for the pump 40 into a heat exchanger 46. The other side of the heat exchanger 46 constitutes part of the lubricating oil flow path for movable components of the system. A lubricant supply pump 48, which may be operated by an auxiliary power source or driven by the shaft 42 is provided with lubricating oil from an oil accumulator 50 and circulates lubricating oil to the parts requiring such lubrication. Heat transferred to the lubricating oil is dissipated to the water in the heat exchanger 46.

From the lubricating oil heat exchanger 46, water is passed via a check valve to the inlet 28 of the working fluid chamber 12. To prevent still superheated steam from the turbine 18 from passing to the condenser-subcooler 36, a recirculating line 54 restricted to an orifice 55 feeds back a small proportion of already cooled water to the line 34 and thus to the condenser-subcooler 36. Control of water flow to the working fluid chamber 12 is achieved by cutting out the pump 40 by means of a by-pass valve 56 operated by the controller 22.

A further component of the system is a storage vessel 58. The storage vessel 58 includes an oxygen outlet 60 from the interior via a filter 62. A squib opened valve 64 fired by the controller 22 is disposed in a line 66 interconnecting the outlet 60 and an injector 68 for oxygen in the reaction chamber 14. Upon system start up, the valve 64 is fired to open.

As a last structural component of the system, there is provided a reaction water source 70. When the system is to be used under water, as for example, propelling a torpedo, the source 70 may be the body of water itself, such as the sea. Water is contained within the source 70 under pressure or the same may be expelled therefrom by a suitably driven pump. In either event, the water is fed to a throttling valve 72 controlled by the controller 22 and then to a tee 74. One branch of the tee 74 extends to an inlet 76 for the reaction chamber 14 while the other branch of the tee 74 extends to an inlet 78 to the storage vessel 58.

As inferred above, one reactant for providing heat to the system is water from the reaction water source 70. A second reaction material is a body 80 of lithium metal within the reaction chamber 14. The third reactant is oxygen from a source preferably in the form of a body 82 of a material that will decompose in the presence of water to generate oxygen. A preferred material is sodium superoxide although potassium superoxide will operate as will other Group IA superoxides. A desirable attribute of the superoxide is that, upon decomposition, the resulting compound is one that is readily soluble, preferably in water. Where sodium superoxide is utilized, the product will be sodium oxide and in view of the admission of water in the storage vessel 58, most, if not all of the residue therein will be sodium hydroxide.

The reaction occurring in the storage vessel 58 is $$4NaO_2+2H_2O \rightarrow NaOH+3O_2+\text{Heat}$$

Such heat as is liberated in the decomposition reaction assures that there will be no freeze-up of the powdered sodium superoxide therein.

In the reaction chamber 14, the admission of water from the reaction water source 70 causes the following reaction to occur:

$$12Li+12H_2O \rightarrow 12LiOH+6H_2+\text{Heat}$$

The reaction is, of course, exothermic, liberating heat and such heat is utilized to vaporize the working fluid in the working fluid chamber 12.

A second reaction also occurs in the reaction chamber 14. Specifically, the hydrogen produced by the lithium-water reaction outlined above is combined with oxygen received from the storage vessel 58 via the inlet 68 according to the following reaction:

$$6H_2+3O_2 \rightarrow 6H_2O+\text{Heat}$$

Again, the heat provided by this exothermic reaction is utilized to heat the working fluid in the working chamber 12.

It will be observed that the products of the reactions occurring in the reaction chamber 14 are lithium hydroxide and water, the former to the extent it may be found in a lithium oxide form, being readily dissolvable in water.

As a consequence, it will be appreciated that the system may be readily reused since all reaction products are readily soluble and can be removed from the reaction chamber 14 and the storage vessel 58 simply by flushing with water.

It will also be appreciated that the reaction is self starting upon contact of water with the lithium thereby eliminating the need for high energy chemical starters such as aluminum potassium perchlorate which have heretofore caused damage to boiler components.

It will also be observed that the highly corrosive, heretofore used sulfur hexafluoride oxidant is eliminated entirely and that damage to injection nozzles is avoided thereby facilitating reuse of the system.

As alluded to previously, one application for a power source made according to the invention is in a closed cycle torpedo. However, the invention may be utilized with efficacy in other applications where a rapidly starting source of power completely independent of the environment is required as, for example, in spacecraft power supplies or aircraft emergency power supply systems. The water necessary to activate the system need only be carried in a suitable storage container.

I claim:

1. An easily reusable chemical power source comprising:

a boiler including a working fluid chamber in heat exchange relation with a reaction chamber;

a closed working fluid circuit including (a) a turbine connected to said working fluid chamber for receiving pressurized working fluid therefrom and for providing a power output;

(b) a heat exchanger connected to said turbine for receiving spent working fluid therefrom and cooling the same; and (c) a pump connected to said heat exchanger for receiving cooled working fluid therefrom and for returning the cooled working fluid to said working fluid chamber;

a body of material exothermically reactive with water to produce a first readily water soluble compound and hydrogen in said reaction chamber said material comprising lithium;

an oxygen inlet in said reation chamber;

a storage vessel having an oxygen outlet connected to said oxygen inlet;

a body of material in said storage vessel adapted to decompose in the presence of water to generate oxygen and a second readily water soluble compound, said body of material comprising a superoxide of a Group 1A metal;

a single reaction water source; and means for providing water from said source to (a) said reaction chamber to cause an exothermic reaction between said body of material therein and the water and to generate hydrogen in said reaction chamber, and (b) said storage vessel to generate and drive oxygen to said reaction chamber to cause an exothermic reaction between the hydrogen generated therein and the oxygen, said exothermic reactions heating the working fluid in said working fluid chamber;

said reaction chamber and said storage vessel being readily prepared for reuse by introducing a solvent(s) for the reaction products respectively therein, said solvents(s) comprising water;

said working fluid being water and said heat exchanger being a condenser, and further including a working fluid water source separate from said reaction water source and connectable to said working fluid circuit;

a check valve interposed between said working fluid water source and said circuit for allowing flow to the circuit but not the reverse; and selectively operable means for connecting said working fluid water source and said check valve to said circuit, said selectively operable means comprising a squib and a burst disc, said squib, when fired, being operable to pressure said working fluid water source sufficiently to burst said burst disc and drive the working fluid water therein through said check valve to said circuit.

2. The power source of claim 1 further including a lubricant heat exchanger adapted to cool lubricant utilized in said power source, said pump further being operative to deliver working fluid water to said heat exchanger to provide a cooling medium for the lubricant.

* * * * *